US007022028B2

(12) United States Patent
Nagai et al.

(10) Patent No.: US 7,022,028 B2
(45) Date of Patent: Apr. 4, 2006

(54) IRON GOLF CLUB AND GOLF CLUB SET WITH VARIABLE WEIGHT DISTRIBUTION

(75) Inventors: Masao Nagai, Suwanee, GA (US); David G. Llewellyn, Duluth, GA (US); Harry B. Taylor, Old Hickory, TN (US); Mamoru Saraie, Osaka (JP); Isamu Toshinari, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/903,245

(22) Filed: Jul. 31, 2004

(65) Prior Publication Data

US 2005/0085312 A1 Apr. 21, 2005

Related U.S. Application Data

(63) Continuation-in-part of application No. 10/757,131, filed on Jan. 14, 2004, which is a continuation of application No. 09/976,496, filed on Oct. 12, 2001, now Pat. No. 6,709,345.

(30) Foreign Application Priority Data

Oct. 16, 2000 (JP) ..... 2000-314678

(51) Int. Cl.
*A63B 53/04* (2006.01)

(52) U.S. Cl. ..... 473/291; 473/350

(58) Field of Classification Search ..... 473/290–291, 473/350
See application file for complete search history.

(56) References Cited

U.S. PATENT DOCUMENTS

| | | | | |
|---|---|---|---|---|
| 4,915,386 | A | 4/1990 | Antonious | |
| 5,282,625 | A | 2/1994 | Schmidt et al. | |
| 5,330,187 | A | 7/1994 | Schmidt et al. | |
| 5,333,872 | A | 8/1994 | Manning et al. | |
| 5,413,336 | A | 5/1995 | Iwanaga | |
| 5,749,795 | A | 5/1998 | Schmidt et al. | |
| 5,807,191 | A | 9/1998 | Nakahara | |
| 5,816,936 | A | 10/1998 | Aizawa et al. | |
| 6,210,290 | B1 | 4/2001 | Erickson | |
| D454,932 | S | 3/2002 | Mahaffey et al. | |
| 6,695,937 | B1 * | 2/2004 | Stites, III | 148/577 |
| 6,709,345 | B1 * | 3/2004 | Iwata et al. | 473/291 |

FOREIGN PATENT DOCUMENTS

EP 0 622 095 A1 11/1994

(Continued)

*Primary Examiner*—Stephen Blau
(74) *Attorney, Agent, or Firm*—Troutman Sanders LLP; Gerald R. Boss, Esq.

(57) ABSTRACT

An iron golf club and a set of iron golf clubs that have a variable weight distribution. Each iron golf club head has a cavity and a raised wall portion that extends upward from the sole and offset from the cavity. The raised wall portion is separated from the cavity by a groove set at an oblique angle to the face portion of the iron golf club The groove deepens the center of mass depth and lengthens the effective face length of the iron golf club. The width of the groove may vary between each golf club in a set of iron golf clubs, such that the width of the groove of the long irons is greater that the width of the groove of the middle irons, and the width of the groove of the middle irons is greater than the width of the groove of the short irons.

34 Claims, 6 Drawing Sheets

FOREIGN PATENT DOCUMENTS

| | | |
|---|---|---|
| GB | 2288984 | 11/1995 |
| GB | 2331249 | 5/1999 |
| JP | 5-27951 | 7/1993 |
| JP | 6-134047 | 5/1994 |
| JP | 6-343722 | 12/1994 |
| JP | 6-343723 | 12/1994 |
| JP | 7-204301 | 8/1995 |
| JP | 3035480 | 3/1997 |
| JP | 10-024130 | 1/1998 |
| JP | 3045407 | 2/1998 |
| JP | 11-047322 | 2/1999 |
| JP | 11-114109 | 4/1999 |
| JP | 11-178960 | 7/1999 |
| JP | 11-216204 | 8/1999 |
| JP | 3066989 | 3/2000 |
| JP | 2001-212266 | 8/2001 |

* cited by examiner

IRON GOLF CLUB AND GOLF CLUB SET WITH VARIABLE WEIGHT DISTRIBUTION

CROSS-REFERENCE TO RELATED APPLICATIONS

This application is a Continuation-in-Part of U.S. patent application Ser. No. 10/757,131 filed on Jan. 14, 2004, which is a Continuation Patent Application of U.S. patent application Ser. No. 09/976,496 filed on Oct. 12, 2001 now U.S. Pat. No. 6,709,345, which claims priority from Japanese Patent Application Serial No. 2000-314678 filed on Oct. 16, 2000.

TECHNICAL DESCRIPTION OF THE INVENTION

The present invention is directed to an iron golf club head and more particularly to a cavity-back iron golf club head having raised wall portion, which is offset from the cavity and a variable width groove that increases the center of gravity depth of the iron golf club head and increases the effective hitting surface.

BACKGROUND

Perimeter weighted iron golf club heads have become increasingly popular with golfers since they were first introduced in the 1980's. The cavity-back iron golf club head moved most of the weight that was located behind the face of the golf club out to the perimeter of the golf club, which enlarged the "sweet spot" of the golf club and made the golf club more forgiving on "off-center" hits as compared to the traditional "blade"-type irons. Also, by moving the weight towards the perimeter, the thickness of the faces of the cavity back iron golf clubs was uniform and relatively thin. This results in a significant reduction in the amount of carry in the case of off-center hits where the golf ball is struck at a location other than the sweet spot, especially toward the toe area of the face.

Another problem with traditional cavity-back iron golf clubs is that not much of the weight is offset from the face portion. As a result, the center of gravity depth, was not very great. One attempt to overcome this problem was to "offset" the clubface from the shaft portion, thereby placing the majority of the weight behind the club head. Although the offset of the golf club increased the increased the COG depth, it made the club unattractive to the golfer, especially those golfer who preferred the look of the traditional blade-type irons.

Yet another problem with the traditional cavity-back iron golf clubs is that they have been produced by investment cast methods, since their unusual shape (i.e., perimeter weighting and offset) made them difficult and expensive to produce through forging. Unfortunately, making iron golf club heads using investment cast methods tends to makes the clubs have a distinctive "harder feel" than the traditional "soft feel" of forged carbon steel irons, which most players traditionally favor.

Therefore, there is a continuing need for an iron golf club head that has the improved playability properties of cavity-back golf clubs, while retaining the look and characteristics of traditional forged, blade-type golf clubs. In particular, there is a need for a forged iron golf club head that provides an increased center of gravity depth, and a large sweet spot.

SUMMARY OF THE INVENTION

The present invention meets the needs described above in an iron golf club head. Generally described, the invention includes an iron golf club head having a cavity, a face portion for striking a golf ball, a heel portion, a toe portion, a top portion and a sole portion. The iron golf club head also includes a raised wall portion extending upward from the sole portion and offset from the portion to lower the center of mass down toward the sole portion and backwards away from the cavity. The iron golf club head further includes a tapered weight within the cavity that extends upward from the sole portion. The tapered weight has a thickness that is tapered from the toe portion to the heel portion so that the thickness of the tapered weight is thicker towards the toe portion than toward the heel portion to provide a more solid feel on off-center hits toward the toe of the iron golf club.

The iron golf club may further include a groove extending between the raised wall portion and the cavity and set at an oblique angle from the face portion so that it is parallel the tapered weight. The groove allows a greater amount of weight to be distributed to the raised wall portion, thereby moving the center of mass depth farther away from the face portion, and thus increasing the effective loft of the iron golf club head. The groove may also lengthen the effective face length of the iron golf club head. Here, the effective face length refers to a length of a portion of the face portion that can flex when striking a golf ball and is defined to be a length in the direction from the sole portion toward the top portion of the iron golf club.

The iron golf club may further include a cavity pad located within the cavity and extending from the top of the tapered weight upward to the top of the cavity to reinforce the upper cavity and reduce unwanted vibrations that may occur during the striking of a golf ball.

The invention may also include a set of iron golf clubs that include at least one long iron golf club, at least one middle iron golf club, and at least one short iron golf club that have a cavity, face portion, a heel portion, a toe portion, a sole portion, and a raised wall portion that extends upward from the sole potion and is offset from the cavity. Each long iron golf club, middle iron golf club, and short iron golf club within the set may also have a groove that extends between the raised wall portion and the cavity portion at an oblique angle to the face portion. The width of the groove may vary between each long iron golf club, middle iron golf club, and short iron golf club, such that the width of the groove of each long iron is greater than the width of the groove of each middle iron and the width of the groove in each middle iron is greater than the width of the groove of each short iron.

The various aspects of the present invention may be more clearly understood and appreciated from a review of the following detailed description of the disclosed embodiments and by reference to the appended drawings and claims.

DETAILED DESCRIPTION OF THE EMBODIMENTS

Figure 1:
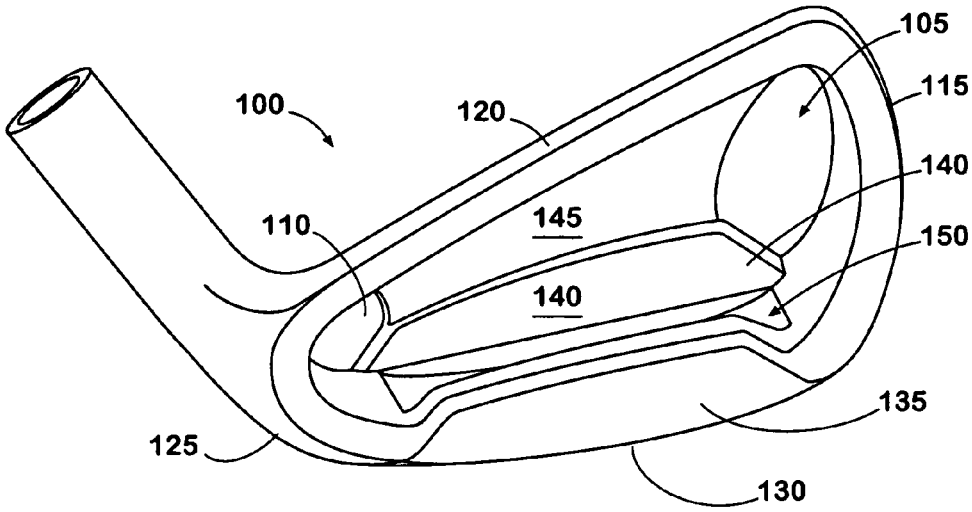
FIG. 1 is an illustration of a bird's eye view of an iron golf club head in accordance with some embodiments of the present invention.

FIG. 1 is a diagram illustrating a bird's eye view of an iron golf club head 100 in accordance with some embodiments of the present invention. The iron golf club head 100 may include a cavity 105, which contains a back wall 110 and is surrounded by a toe portion 115, a top portion 120, a heel portion 125 and a sole portion 130. The iron golf club head 100 may also includes a face portion (not shown), which is used for striking a golf ball.

The back wall 110 of the cavity 105 may include a tapered weight 140 that may be positioned toward the sole portion 130 within the cavity 110. The tapered weight 140 may have a predetermined length, which is less than the length of the cavity 105 and may extend along an axis extending from the toe portion 115 to the heel portion 125. The tapered weight 140 is positioned directly behind the ball hitting portion of the face portion to provide a high coefficient of restitution (COR), which is typically greater than 0.8. The length of the tapered weight 140 is approximately 60 millimeters in length. Additionally, the tapered weight 140 may be trapezoidal in shape. This concentration of mass increases the so-called "sweet spot" on the face portion, thereby improving the "feel" of the golf club for the average golfer. Although the tapered weight 140 has been described as being trapezoidal in shape, those skilled in the art will appreciate that the tapered weight 140 may be any geometric shape, such as rectangular, triangular, circular, semi-circular, any combination thereof, and the like, without departing from the scope to the invention.

The tapered weight 140 may also have a thickness that is tapered along its length from the toe portion 115 to the heel portion 125. The thickness of the tapered weight 140 may be approximately three (3) millimeters toward the toe portion 115, while the thickness of the may be approximately one (1) to two (2) millimeters toward the heel portion 125. The taper allows more mass to be placed toward the toe portion 115 of the iron golf club head 100. The additional mass toward the toe portion allows for "off-center" hits toward the toe on the face portion to feel more solid The back portion 110 of the iron golf club head 100 may also contain a cavity pad 145, which extends between the top of the tapered weight 140 and the top of the cavity 105. The cavity pad 145 may have a uniform thickness across its length, which is typically less than the thickness of the tapered weight 140 and may be approximately one (1) millimeter. The cavity pad 145 reinforces the upper portion of the cavity 105. The inclusion of the cavity pad 145 provides an advantage over traditional cavity backed iron golf clubs. In traditional cavity-backed iron golf clubs, since the majority of the weight is moved toward the perimeter of the golf club, the cavity may resonate, or vibrate, especially on off-center hits, making the club feel unstable. The cavity pad 145 provides a reinforcement of the upper portion of the cavity 105 and therefore, reduces unwanted vibrations within the cavity 105 producing a solid feel back to the golfer when striking a golf ball, especially on off-center hits.

The iron golf club head 100 may also include a projected wall portion 135, which is offset from the back wall 110 of the cavity 105 and extends upward from the sole portion 130. The projected wall portion 135 may be offset from the back wall 110 between approximately eight (8) and fifteen (15) millimeters. This allows more of the weight to be positioned farther back from the face portion and closer to the sole portion, which in turn increases the center of gravity (COG) depth.

Additionally, the projected wall portion 130 has a predefined thickness, which may be tapered along its length from the toe portion 115 to the sole portion 125. In one embodiment, the projected wall portion has a thickness of approximately 3.5–5.5 millimeters toward the toe portion 115, and a thickness of approximately 2.5–3.5 millimeters toward the heel portion 125. The taper provides additional weight toward the toe portion 115 of the iron golf club 100 to provide further stability and promote a more solid feel to a golfer when the ball is struck off-center toward to the toe of the face portion. The projected wall portion 135 has a length, which is less than the length of the cavity 105 extending along the axis from the heel portion 125 to the toe portion 115. The projected wall portion 135 is typically trapezoidal in shape with the base of projected wall portion 130 being the adjacent to the sole portion 130. Those skilled in the art will appreciate that the projected wall portion 135 may be in the form of other shapes, such as a triangle, a rectangle, a square, a circle, a semi-circle, and the like without departing from the scope of the invention.

The iron golf club 100 may further contain a groove 150 running between the back wall 110 of the cavity 105 and the projected wall portion 135. The groove 150 extends in a direction from the toe portion 115 towards the heel portion 125 and may be set at an oblique angle relative to the back wall 145 of the cavity 105. The groove 150 may be positioned such that the end of the groove 150 toward the toe portion 115 is located farther away from the back wall 110 of the cavity than the end of the groove 150 located toward the heel portion 125. Typically, the groove 150 may be angled so that it is oriented parallel to the tapered weight 140. By orienting the groove 150 parallel to the tapered weight 140, more weight may be placed toward the toe portion 115 to further provide a solid feel on off-center hits that occur towards the toe portion 115 of face portion.

The groove 150 may have a width, W, in the range of approximately eight (8) and fourteen (14) millimeters. As the width of the groove 150 increases, more of the iron golf club's weight may be redistributed farther back from the cavity 105. Thus, as the more weight is moved backward away from the cavity 105, the center of gravity depth of the iron golf club 100 may be increased, which in turn may increase the effective loft of the iron golf club 100.

Figure 2:
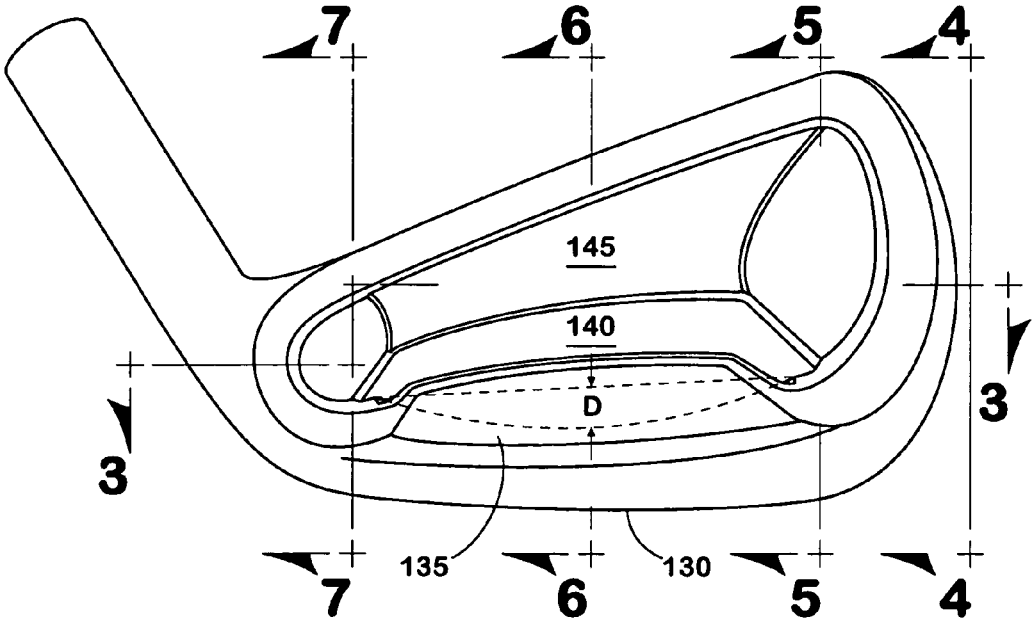
FIG. 2 is an illustration of a long iron golf club head viewed from the rear in accordance with some embodiments of the present invention.

The groove 150 also has a depth, D, as shown in FIG. 2. The depth, D of the groove 150 may change in the direction from the toe portion 115 to the heel portion 125. For example, as shown in FIG. 2, the groove 150 begins at the toe portion 115 at the 5—5 line and gradually increases in depth until it reaches the 6—6 line and then gradually decreases in depth until it reaches the 7—7 line toward the heel portion 125. Typically, the groove 150 will have a maximum depth at the 6—6 line in the range of approximately eight (8) to nine (9) millimeters. In one embodiment the maximum depth of the groove 150 may be 8.5 millimeters. The varying depth of the groove 150 is for a long iron golf club is shown in FIGS. 4–7, which respectively show the cross sectional views taken along the 4—4 line, the 5—5 line, the 6—6 line, and the 7—7 line of the iron golf club 100 shown in FIG. 2. By providing the groove 150, as described above, the effective face length may be lengthened to make the face portion more flexible, thereby increasing the coefficient of restitution property of the face portion.

The groove 150 may be formed by milling (cutting) a top surface on the projected wall portion 135 using an appropriate milling tool. According to some embodiments, the milling tool is set at an angle so as to make the groove 150 parallel to both the tapered weight pad 145 and the face portion. The width of the groove 150 may be varied between anywhere between zero (0) and nine (9) millimeters by selecting the appropriate size milling bits. In some instances, it may be necessary to mill the groove 150 in two stages: a rough milling stage, in which the majority of the material is removed and a fine milling stage, in which the groove 150 is cut to its final width and smoothed.

Additionally, the iron golf club head 100 may be used to create a golf club set, which includes at least one long iron golf club (for instance No. 1 through No. 5 iron golf clubs) shown in FIGS. 3 through 7, at least one middle iron golf club (for instance No. 6 and No. 7 iron golf club heads) shown in FIGS. 8 through 12, and at least one short iron golf club (for instance No. 8 to a pitching wedge and sand wedge iron golf club heads) shown in FIGS. 13 through 18. Each of the long iron golf clubs, the middle iron golf clubs and the short iron golf clubs 100 may include a cavity 105, which contains a back wall 110 and is surrounded by a toe portion 115, a top portion 120, a heel portion 125 and a sole portion 130. The iron golf club head 100 may also includes a face portion (not shown), which is used for striking a golf ball. Each of the long iron golf clubs, middle iron golf clubs, and short iron golf clubs may also have a tapered weight portion 140. Additionally, each of the long iron golf clubs, middle iron golf clubs, and short iron golf clubs may also have a projected weight portion 135 that is offset from the cavity 105.

Figure 3:
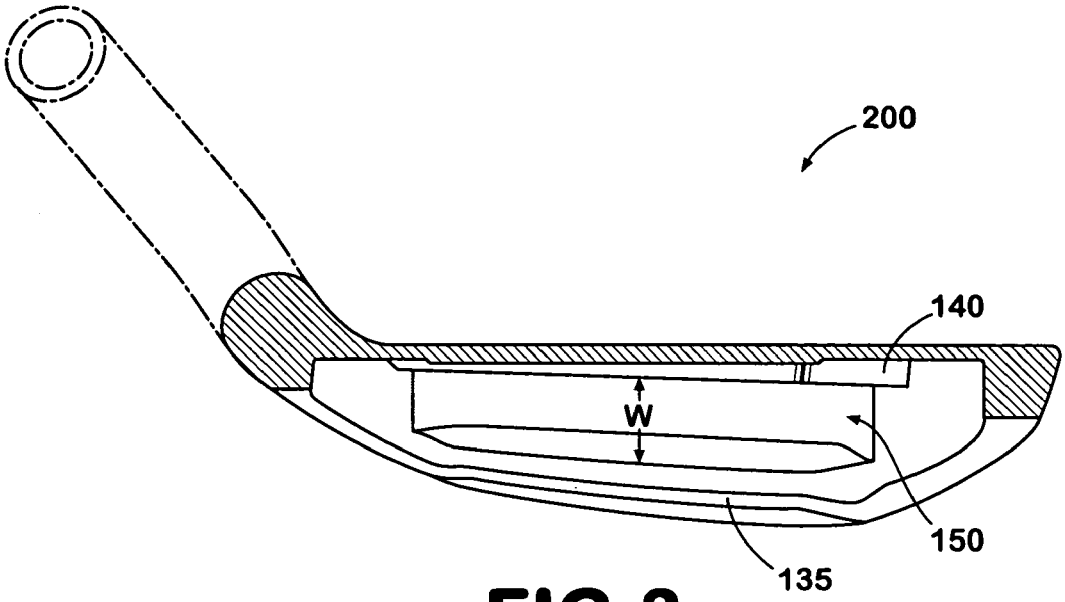
FIG. 3 is an illustration of a long iron golf club viewed along the 3—3 line of FIG. 2 in accordance with some embodiments of the present invention.
Figure 4:
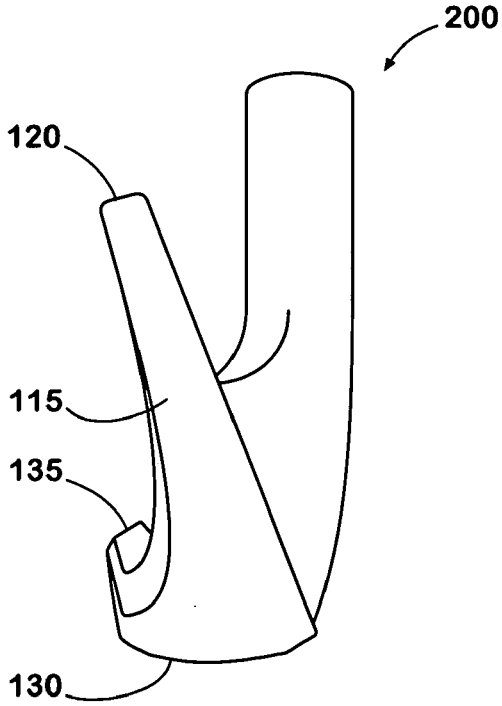
FIG. 4 is an illustration of a long iron golf club viewed along the 4—4 line of FIG. 2 in accordance with some embodiments of the present invention.
Figure 5:
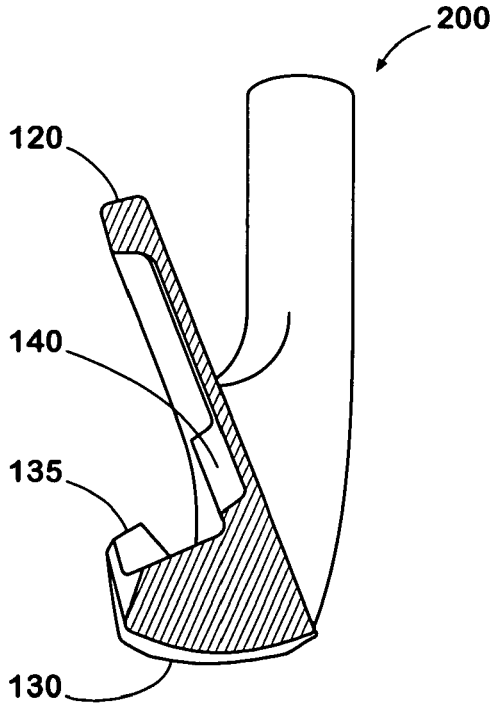
FIG. 5 is an illustration of a long iron golf club viewed along the 5—5 line of FIG. 2 in accordance some embodiments of the present invention.
Figure 6:
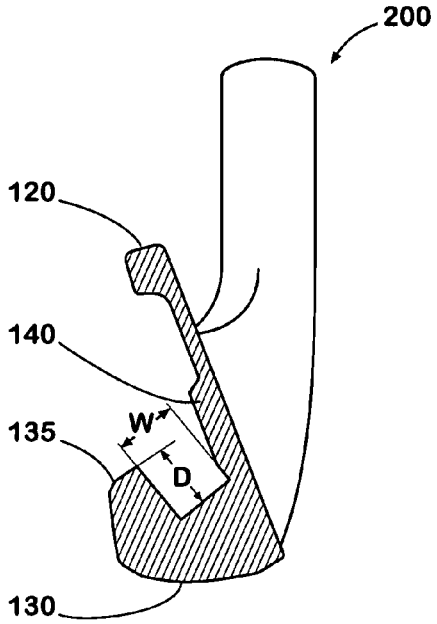
FIG. 6 is an illustration of a long iron golf club viewed along the 6—6 line of FIG. 2 in accordance with some embodiments of the present invention.
Figure 7:
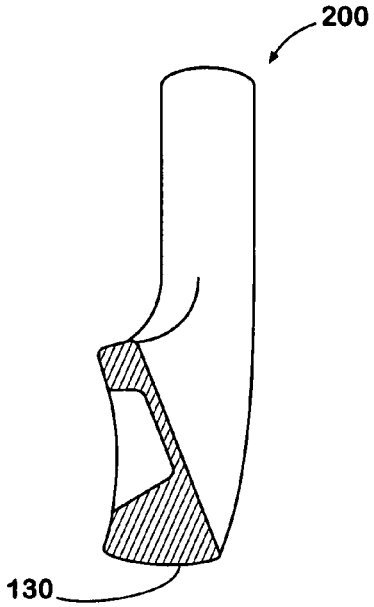
FIG. 7 is an illustration of a long iron golf club viewed along the 7—7 line of FIG. 2 in accordance with some embodiments of the present invention.

Each of the long iron golf clubs, middle iron golf clubs, and short iron golf clubs may also have a groove 150, whose width may vary between the long iron golf clubs, the middle iron golf clubs, and the short iron golf clubs. For example, the width of the groove 150 may decrease from the long irons to the middle irons, and from the middle irons to the short irons within the golf club set. FIG. 3 illustrates a cross-section view of a long iron for the iron golf club head 100 taken along the 3—3 line in FIG. 2. The width of the groove 150 for the long iron golf clubs (for instance the No. 1 through the No. 5 irons) is set at an oblique angle from the face portion and is generally parallel to the tapered weight 140. In one embodiment, the groove 150 may have a width in the range of approximately seven (7) to nine (9) millimeters. The orientation and relatively large width of the groove provides improved playability characteristics. For example, the long irons have a COG depth of approximately four (4) millimeters, a COG from the shaft axis of approximately 35.7 millimeters and "sweet spot" of approximately 3.8 square millimeters. Additionally, the long iron golf club heads may have a moment of inertia (MOI) along the axis from the toe portion 115 to the heel portion 125 of approximately 2151 and a MOI along the axis from the top portion 120 to the sole portion 130 of approximately 556. FIGS. 4 through 7 show the cross section views taken along the 4—4 line, the 5—5 line, the 6—6 line, and the 7—7 line of FIG. 2.

Figure 8:
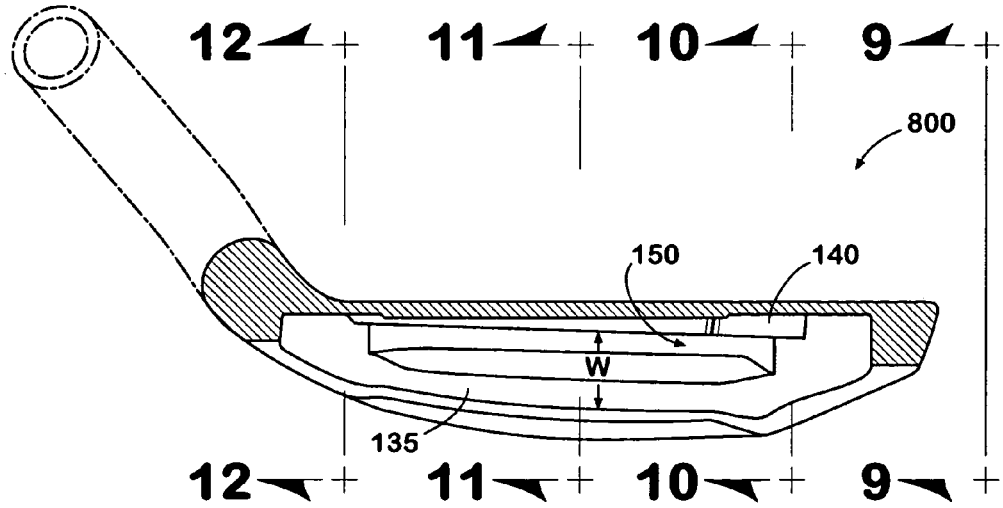
FIG. 8 is an illustration of a middle iron golf club viewed along the 3—3 line of FIG. 2 in accordance with some embodiments of the present invention.
Figures 9, 10, 11, 12:
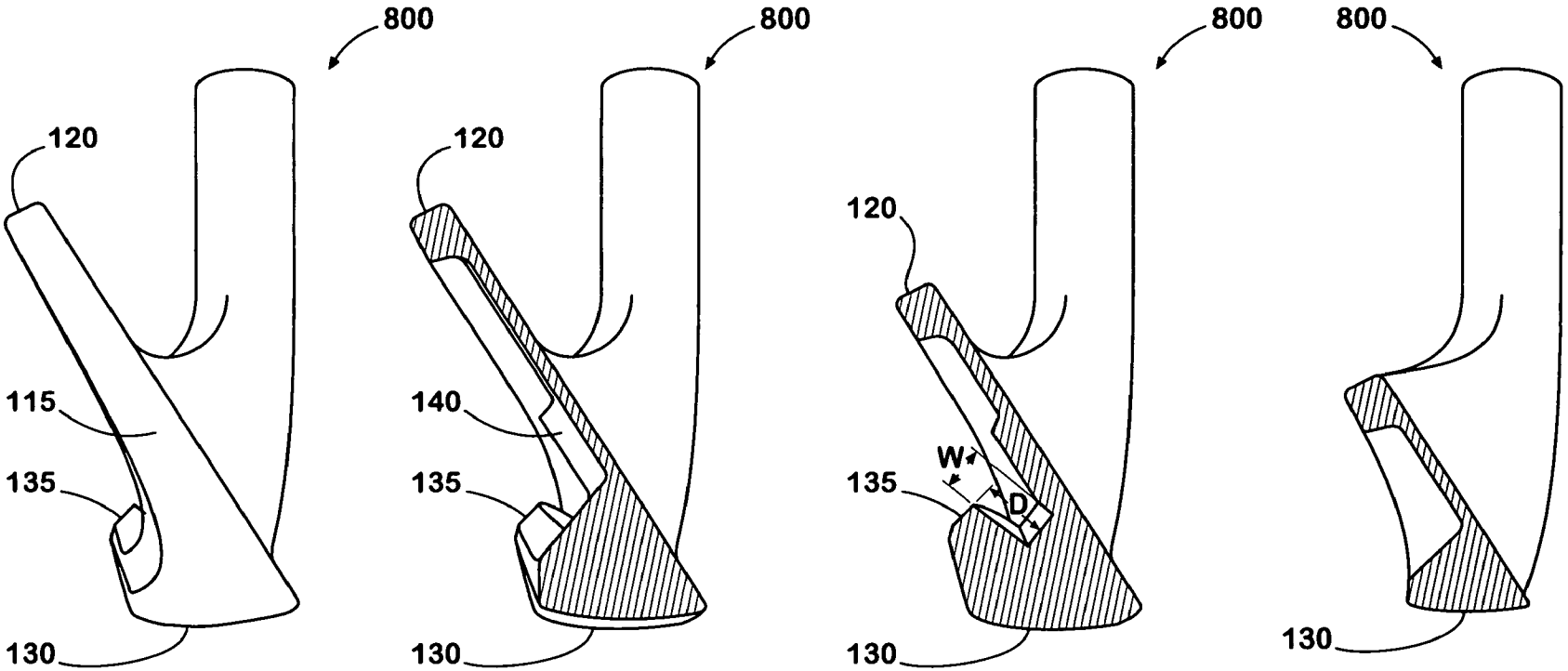
FIG. 9 is an illustration of a middle iron golf club viewed along the 9—9 line of FIG. 8 in accordance with some embodiments of the present invention.
FIG. 10 is an illustration of a middle iron golf club viewed along the 10—10 line of FIG. 8 in accordance with some embodiments of the present invention.
FIG. 11 is an illustration of a middle iron golf club viewed along the 11—11 line of FIG. 8 in accordance with some embodiments of the present invention.
FIG. 12 is illustration of a middle iron golf club viewed along the 12—12 line of FIG. 8 in accordance with some embodiments of the present invention.
Figure 13:
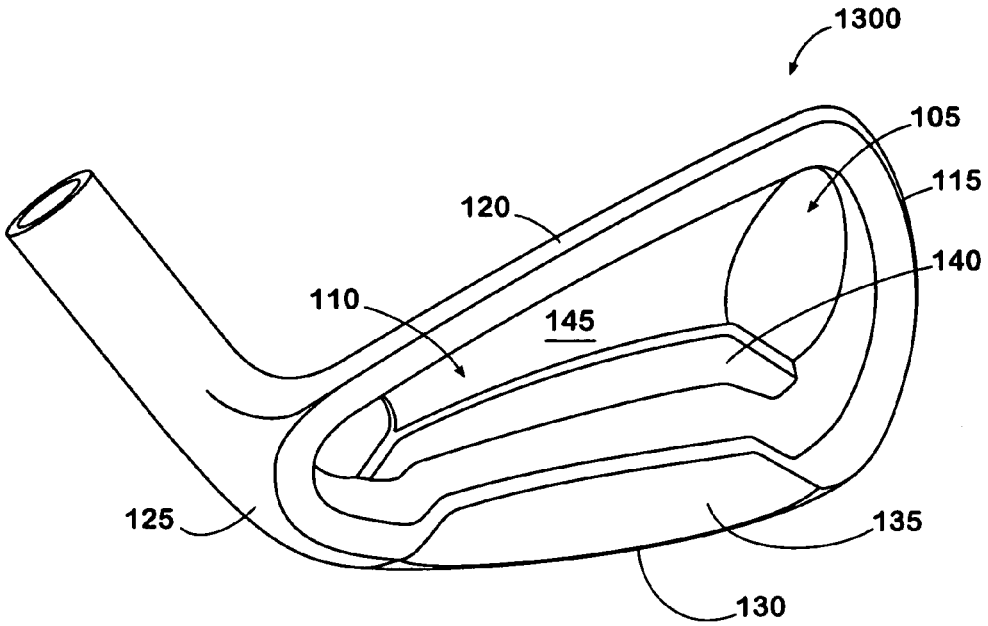
FIG. 13 is an illustration of a bird's eye view of a short iron golf club in accordance with some embodiments of the present invention.
Figure 14:
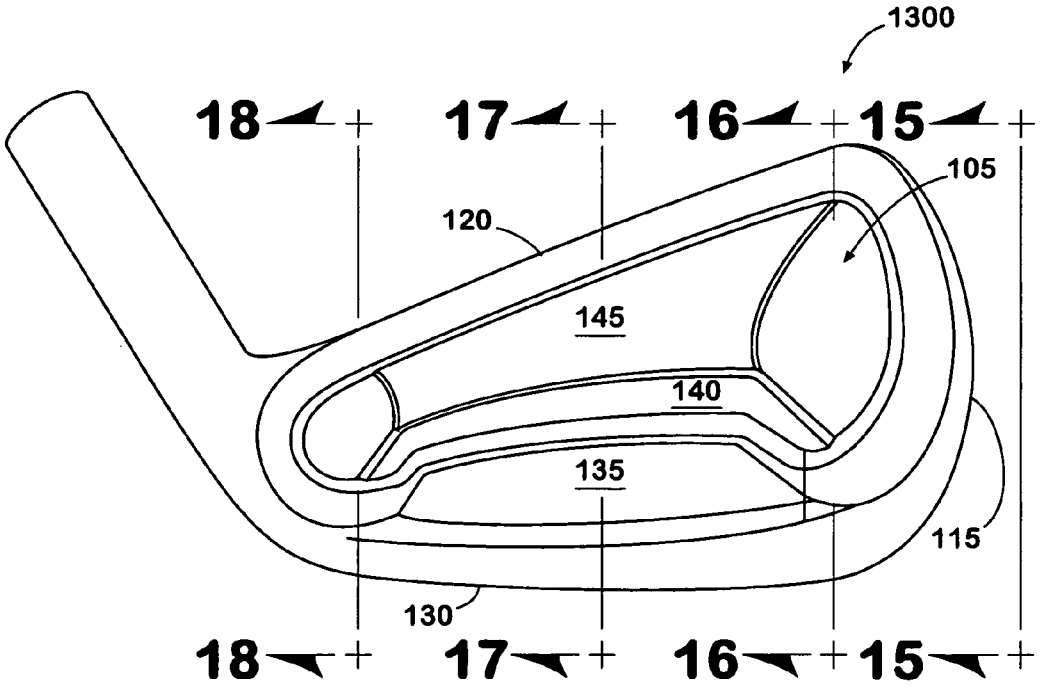
FIG. 14 is an illustration of a short iron golf club viewed from the rear in accordance with some embodiments of the present invention.
Figures 15, 16, 17, 18:
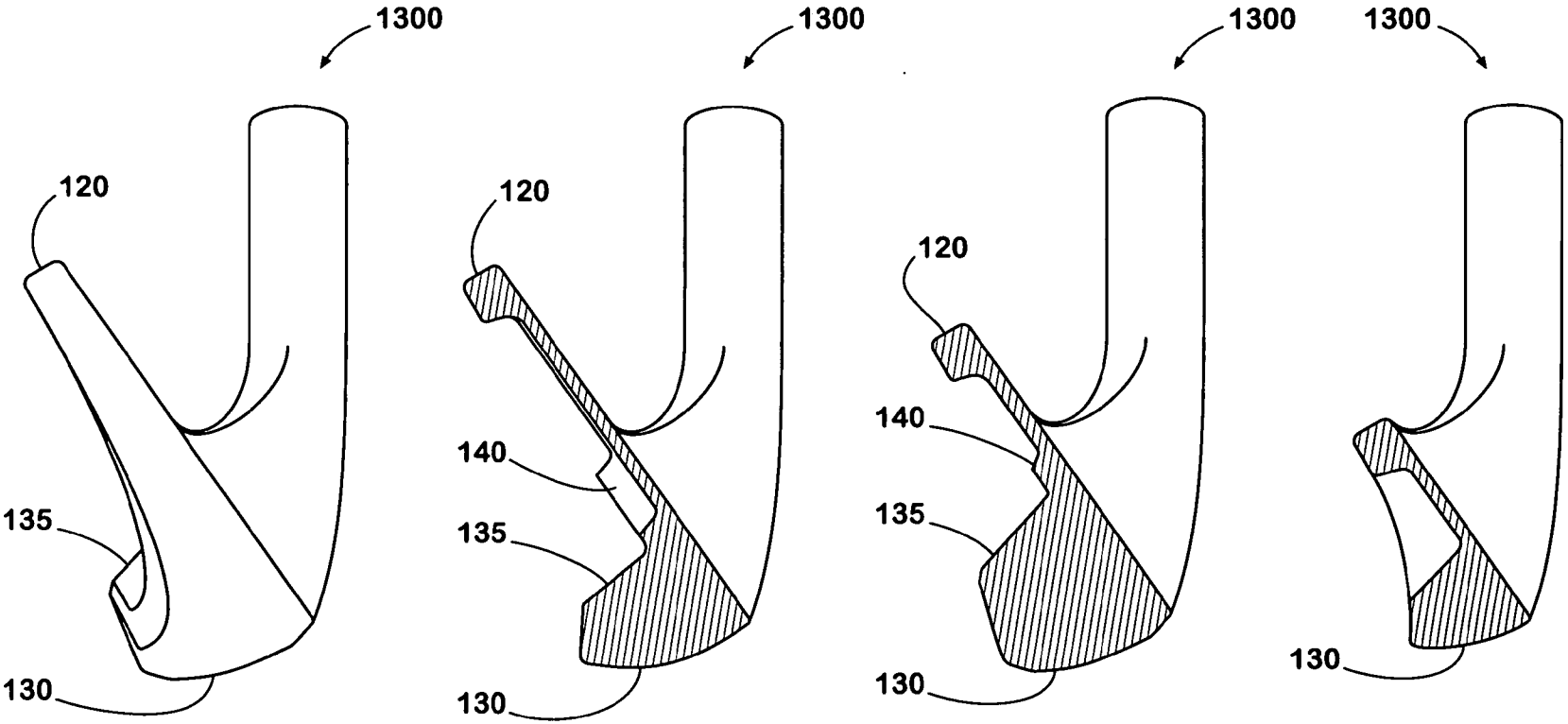
FIG. 15 is a diagram illustrating a short iron golf club viewed along the 15—15 line of FIG. 14 in accordance with some embodiments of the present invention.
FIG. 16 is an illustration of a short iron golf club viewed along the 16—16 line of FIG. 14 in accordance with some embodiments of the present invention.
FIG. 17 is an illustration of a short iron golf club viewed along the 17—17 line of FIG. 14 in accordance with some embodiments of the present invention.
FIG. 18 is an illustration of a short iron golf club viewed along the 18—18 line of FIG. 14 in accordance with some embodiments of the present invention.

In the middle irons, the width of the groove 150 for an iron golf club head 100 used for the middle irons may be in the range of approximately five (5) to (7) millimeters. FIG. 8 illustrates a cross-sectional view of the iron golf club head 100 taken along the 3—3 line in FIG. 2 for a middle iron. The orientation and width of the groove 150 allows the middle irons to have a COG depth of approximately 3.2 millimeters, a COG from the shaft axis of approximately 35.7 millimeters and "sweet spot" of approximately 4.7 square millimeters. Additionally, the middle iron golf club heads may have a moment of inertia (MOI) along the axis from the toe portion 115 to the heel portion 125 of approximately 2353 and a MOI along the axis from the top portion 120 to the sole portion 130 of approximately 639. FIGS. 9–12 show the cross-sectional views taken along the 9—9 line, the 10—10 line, the 11—11 line, and the 12—12 line of FIG. 8.

Finally, in the short irons, the width of the groove 150 for the iron golf club head for short irons 1300 (FIG. 13) may be in the approximately zero (0) millimeters. That is, the golf club iron head 1300 for short irons may not contain the groove 150. FIGS. 15–18 show the cross-sectional views of the iron golf club head for a short iron taken along the 15—15 line, the 16—16 line, the 17—17 line, and the 18—18 line of FIG. 14. However, in an alternative embodiment (not shown), the width of the groove 150 for an iron golf club head 100 used for the short irons may be in the range of approximately one (1) to (5) millimeters. The short iron golf club heads have a COG depth of approximately 1.9 millimeters, a COG from the shaft axis of approximately 35.4 millimeters and "sweet spot" of approximately 5.8 square millimeters. Additionally, the middle iron golf club heads may have a moment of inertia (MOI) along the axis from the toe portion 115 to the heel portion 125 of approximately 2494 and a MOI along the axis from the top portion 120 to the sole portion 130 of approximately 737. A summary of the technical characteristics of for the long iron golf club heads, the middle iron golf club heads and the short iron golf club heads in accordance with some embodiments of the invention is shown in Table 1.

TABLE 1

Summary of Technical Characteristics.

| | COG Depth (mm) | COG from Shaft Axis (mm) | Sweet Spot ($mm^2$) | MOI (toe-to-heel) | MOI (top-to-bottom) |
|---|---|---|---|---|---|
| Long Irons | 4.0 | 35.7 | 3.8 | 2151 | 556 |
| Middle Irons | 3.2 | 35.7 | 4.7 | 2353 | 639 |
| Short Irons | 1.9 | 35.4 | 5.8 | 2494 | 737 |

Other alternative embodiments will become apparent to those skilled in the art to which an exemplary embodiment pertains without departing from its spirit and scope. Accordingly, the scope of the present invention is defined by the appended claims rather than the foregoing description.

We claim:

1. An iron golf club head having a cavity, face portion, a heel portion, a toe portion, a top portion and a sole portion, the iron golf club, comprising:

a raised wall portion extending upward from the sole portion and offset from the cavity portion;

a tapered weight within the cavity that extends upward from the sole portion and has a thickness that is tapered from the toe portion to the heel portion; and a groove extending between the raised wall portion and the cavity portion and offset from the face portion at an oblique angle.

2. The iron golf club of claim 1, wherein the groove is oriented parallel to tapered weight.

3. The iron golf club of claim 1, wherein the raised wall portion is tapered from the toe portion to the heel portion.

4. The iron golf club of claim 3, wherein the raised wall portion is substantially trapezoidal in shape.

5. The iron golf club of claim 1, wherein the tapered weight is substantially trapezoidal in shape.

6. The iron golf club of claim 1, wherein the groove has a width in the range approximately between 0 millimeters and 9 millimeters.

7. The iron golf club of claim 1, wherein the groove has a depth in the range approximate between 7 millimeters and approximately 9 millimeters.

8. The iron golf club of claim 1, wherein the groove has a depth of approximately 8.5 millimeters.

9. The iron golf club of claim 1, further comprising:

a cavity pad within the cavity portion and extending from the top of the tapered weight upward to the top of the cavity and has a length along the axis extending from the heel portion to the toe portion that is less than the length of the cavity.

10. The iron golf club of claim 1, wherein the extended wall portion has a length along an axis extending from the heel portion to the toe portion is less than the length of the cavity portion.

11. The iron golf club set of claim 10, wherein the tapered weight portion has a length along an axis extending from the heel portion to the toe portion is less than the length of the cavity portion.

12. A golf club set, comprising at least one long iron golf club at least one middle iron golf club and at least one short iron golf club, wherein each long iron golf club, each middle iron golf club, and each short iron golf club comprises a cavity portion, a face portion, a heel portion, a toe portion, and a sole portion, each long iron golf club, each middle iron golf club, and each short iron golf club comprising:

a raised wall portion extending upward from the sole portion and offset from the cavity; and a groove extending between the raised wall portion and the cavity and offset from the face portion at an oblique angle, wherein the groove has a width, such that the width of the groove of each long iron is greater than the width of the groove of each middle iron, and the width of the groove of each middle iron is greater than the width of each short iron.

13. The golf club set of claim 12, wherein each long iron golf club, each middle iron golf club, and each short iron golf club further comprise a tapered weight within the cavity portion that extends upward from the sole portion and has a thickness that is tapered from the toe portion to the heel portion.

14. The golf club set of claim 13, wherein the groove of each long iron golf club, each middle iron golf club, and each short iron golf club is oriented parallel to the tapered weight.

15. The golf club set of claim 13, wherein the groove of each long iron golf club, each middle iron golf club, and each short iron golf club, wherein the raised wall portion is tapered from the toe portion to the heel portion.

16. The golf club set of claim 12, wherein the tapered weight is substantially trapezoidal in shape and has a length along an axis extending from the heel portion to the toe portion is less than the length of the cavity portion.

17. The golf club set of claim 12, wherein the raised wall portion is substantially trapezoidal in shape.

18. The golf club set of claim 12, wherein the width of the groove of each of the long irons is in the range approximately between 7 millimeters and 9 millimeters.

19. The golf club set of claim 12, wherein the width of the groove of each of the middle iron golf clubs is in the range approximately between 5 and 7 millimeters.

20. The golf club set of claim 12, wherein the width of the groove of each of the short iron golf clubs is in the range between 0 and 5 millimeters.

21. The golf club set of claim 12, wherein the depth of the groove is approximately 8.5 millimeters.

22. The iron golf club of claim 12, further comprising:

a cavity pad within the cavity and extending from the top of the tapered weight portion upward to the top of the cavity.

23. The iron golf club of claim 12, wherein the length of the extended wall portion along an axis extending from the heel portion to the toe portion is less than the length of the cavity.

24. A golf club set, comprising:

at least one long iron golf club at least one middle iron golf club and at least one short iron golf club, wherein each long iron golf club, each middle iron golf club, and each short iron golf club comprise:

a cavity, face portion, a heel portion, a toe portion, and a sole portion; and a raised wall portion extending upward from the sole portion and offset from the cavity portion; and each long iron golf club and each middle iron golf club comprise a groove extending between the raised wall portion and the cavity portion and offset from the face portion at a second oblique angle, wherein the groove has a width, such that the width of the groove of each long iron is greater than the width of the groove of each middle iron.

25. The golf club set of claim 24, wherein each long iron golf club, each middle iron golf club, and each short iron golf club further comprise a tapered weight within the cavity that extends upward from the sole portion and is tapered from the toe portion to the heel portion.

26. The golf club set of claim 25, wherein the groove of each long iron golf club and each middle iron golf club is oriented parallel to the tapered weight.

27. The golf club set of claim 26, wherein the raised wall portion is tapered from the toe portion to the heel portion.

28. The golf club set of claim 24, wherein the tapered weight is substantially trapezoidal in shape.

29. The golf club set of claim 24, wherein the raised wall portion is substantially trapezoidal in shape.

30. The iron golf club of claim 24, wherein the the groove of each of the long irons has a width in the range between 7 millimeters and 9 millimeters.

31. The golf club set of claim 24, wherein the groove of each of the middle iron golf clubs has a width in the range between 5 and 7 millimeters.

32. The golf club set of claim 24, wherein the groove has a maximum depth of approximately 8.5 millimeters.

33. The iron golf club of claim 24, further comprising:

a cavity pad within the cavity and extending from the top of the tapered weight portion upward to the top of the cavity.

34. The iron golf club set of claim 24, wherein the extended wall portion has a length along an axis extending from the heel portion to the toe portion that is less than the length of the cavity.

* * * * *